US006131551A

United States Patent [19]

Jamrog

[11] Patent Number: 6,131,551

[45] Date of Patent: Oct. 17, 2000

[54] METHOD FOR CONTROLLING EVAPORATIVE EMISSION CONTROL SYSTEM

[75] Inventor: James Richard Jamrog, Novi, Mich.

[73] Assignee: Ford Global Technologies, Inc., Dearborn, Mich.

[21] Appl. No.: 09/469,006

[22] Filed: Dec. 21, 1999

[51] Int. Cl.[7] ..... F02M 33/02

[52] U.S. Cl. ..... 123/520; 123/198 D

[58] Field of Search ..... 123/520, 516, 123/518, 519, 521, 198 D

[56] References Cited

U.S. PATENT DOCUMENTS

| | | | |
|---|---|---|---|
| 5,178,117 | 1/1993 | Fujimoto et al. | 123/198 D |
| 5,195,498 | 3/1993 | Siebler et al. . | |
| 5,265,577 | 11/1993 | Denz et al. . | |
| 5,297,527 | 3/1994 | Suzuki et al. | 123/520 |
| 5,398,661 | 3/1995 | Denz et al. . | |
| 5,442,551 | 8/1995 | Denz et al. . | |
| 5,483,942 | 1/1996 | Perry et al. | 123/198 D |
| 5,816,223 | 10/1998 | Jamrog et al. . | |
| 5,878,727 | 3/1999 | Huls . | |
| 5,884,610 | 3/1999 | Reddy | 123/520 |
| 5,957,115 | 9/1999 | Busato et al. | 123/520 |
| 6,016,792 | 1/2000 | Kawano et al. | 123/520 |

*Primary Examiner*—Carl S. Miller
*Attorney, Agent, or Firm*—Jerome R. Drouillard

[57] ABSTRACT

A method is provided for controlling an evaporative emission control system for a motor vehicle. The method includes the steps of periodically measuring a system pressure within the evaporative emission control system and filtering a signal of the system pressure into two separate signals. The method also includes the steps of calculating a pressure difference between the signals and comparing the pressure difference to a predetermined pressure differential threshold limits. The method further includes the steps of adjusting the flow of purged vapor to engine in the event that the calculated pressure difference is outside the predetermined pressure differential threshold limits.

20 Claims, 2 Drawing Sheets

METHOD FOR CONTROLLING EVAPORATIVE EMISSION CONTROL SYSTEM

BACKGROUND OF THE INVENTION

1. Field of the Invention

The present invention relates generally to evaporative emission control systems for motor vehicles and, more specifically, to a method for controlling an evaporative emission control system for a motor vehicle.

2. Description of the Related Art

Government regulations concerning the release into the atmosphere of various exhaust emission constituents from motor vehicles are becoming increasing more stringent. As the stringency related to emissions of oxide of nitrogen, carbon monoxide, and unburned hydrocarbons, inter alia, becomes greater, it is becoming increasingly necessary to control the engine combustion process so as to avoid unnecessary instabilities. Of course, those skilled in the art know that not only engine tailpipe emissions are regulated, but also evaporative emissions. In point of fact, evaporative emission control is a very important consideration in motor vehicle design and necessitates that fuel vapor arising from the engine fuel system be drawn into the engine and burned. Because the fuel vapor can be combusted by the engine, a discontinuous flow of vapor may cause combustion instability or perhaps even engine roughness or stalling.

It is known to provide an evaporative emission control system for providing fuel vapor to an engine for a motor vehicle. An example of such an evaporative emission control system is disclosed in U.S. Pat. No. 5,816,223 to Jamrog et al. In this patent, a method is disclosed for controlling a flow of evaporative fuel vapor to an engine having a liquid fuel storage tank, a carbon vapor storage canister, and a purge system for conveying fuel vapor to the engine from the fuel tank and the carbon canister. The method includes the steps of establishing a vapor flow from the fuel tank and carbon canister through the purge system and into the engine and periodically measuring a purge system pressure within the purge system. The method also includes the steps of calculating a time rate of change of the measured purge system pressure and adjusting the flow of purged vapor to the engine in the event that the calculated time rate of change of the purge system pressure exceeds a predetermined threshold.

Since overall purge flow being drawn into the engine is relatively constant, purge air flow through the canister and vapor flow from the fuel tank are also relatively constant. If vapor flow from the fuel tank changes, air flow through the canister changes proportionally which results in a change in system operating pressure. Feed forward fuel vapor concentration change sensing strategy relies on the monitoring of the evaporative emission control system for significant, sudden changes in system operating pressure.

However, with the advent of plastic fuel tanks, undesirable system noise has been experienced with flexible wall plastic fuel tanks, which may result in false pressure changes or spikes. Also, if excessive pressure signal noise of moderate duration is present, capturing a maximum change pressure by locking in maximum and minimum pressure values when pressure trends switch direction and making pressure change measurements from these points can lead to false purge flow resets.

It is desirable to provide a method for controlling an evaporative emission control system that eliminates false pressure spikes that may be caused by flexible wall fuel tanks. It is also desirable to provide a method for controlling an evaporative emission control system that eliminates false purge flow resets which may occur if excessive pressure signal noise of moderate duration is present. Therefore, there is a need in the art to provide a method for controlling an evaporative emission control system for a motor vehicle, which meets these desires.

SUMMARY OF THE INVENTION

Accordingly, the present invention is a method for controlling an evaporative emission control system for a motor vehicle. The method includes the steps of periodically measuring a system pressure within the evaporative emission control system and filtering a signal of the system pressure into two separate signals. The method also includes the steps of calculating a pressure difference between the signals and comparing the pressure difference to predetermined pressure differential threshold limits. The method further includes the steps of adjusting the flow of purged vapor to an engine in the event that the calculated pressure difference is outside the predetermined pressure differential threshold limits.

One advantage of the present invention is that a new method for controlling an evaporative emission control system is provided for a motor vehicle. Another advantage of the present invention is that the method determines purge vapor concentration changes by looking at the difference between high and low pass filtering of the system pressure. Yet another advantage of the present invention is that the method runs the raw pressure signal through two separate rolling average filters of differing rolling average time constants (time lengths). Still another advantage of the present invention is that the method eliminates the need for complex timers and additional miscellaneous control logic to determine purge system operating pressure change. A further advantage of the present invention is that the method establishes normal system operating pressure via a low pass filtered term and is better able to filter out undesirable system noise which has been experienced with flexible wall plastic fuel tanks. Yet a further advantage of the present invention is that the method has feedforward purge fuel vapor sensing which better filters out false pressure spikes caused by flexible wall plastic fuel tanks.

Other features and advantages of the present invention will be readily appreciated as the same becomes better understood after reading the subsequent description taken in conjunction with the accompanying drawings.

DESCRIPTION OF THE PREFERRED EMBODIMENT(S)

Figure 1:
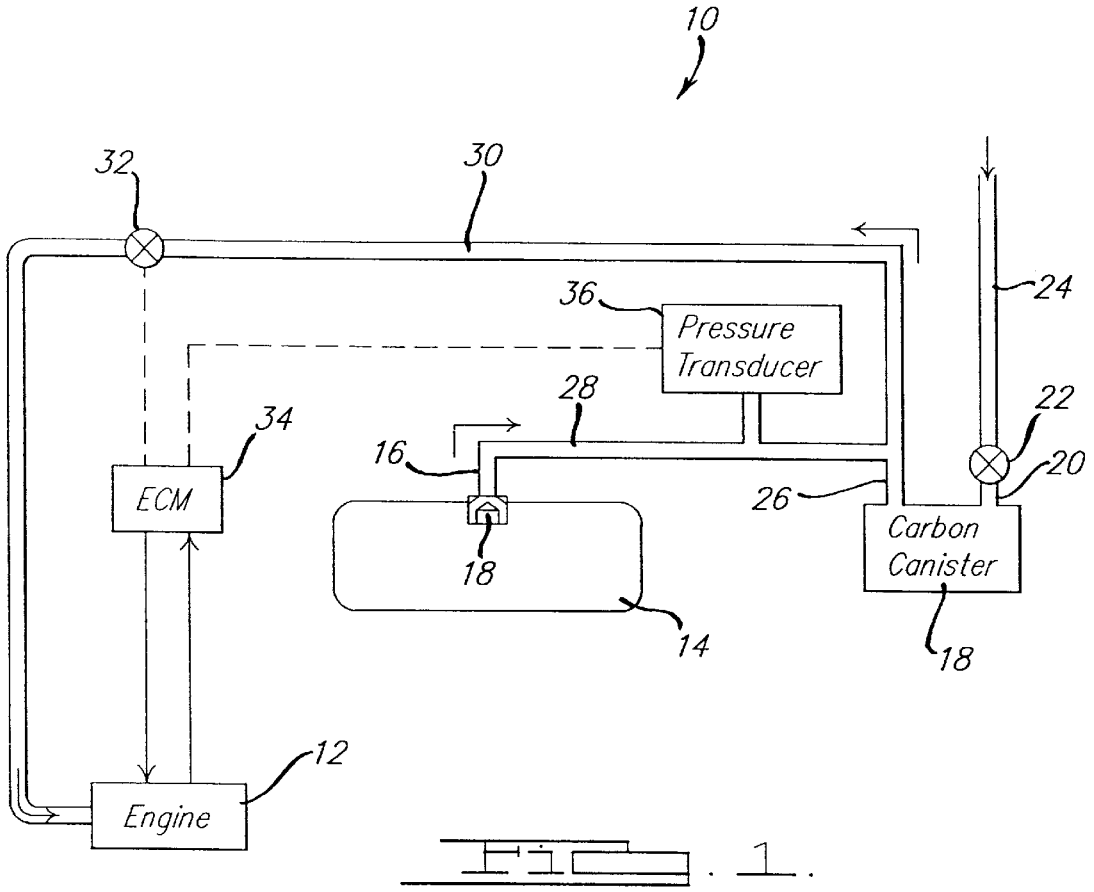
FIG. 1 is a diagrammatic view of an engine having an evaporative emission control system for use with a method, according to the present invention.

Referring to the drawings and in particular FIG. 1, one embodiment of an evaporative emission control system 10 for use with a method, according to the present invention, is illustrated for a motor vehicle (not shown). The motor vehicle includes an engine 12 and a fuel tank 14 connected to the engine 12 to receive fuel from the fuel tank 14. The evaporative emission control system 10 controls vapor generated by fuel contained within the fuel tank 14 and furnished to the engine 12. The fuel tank 14 has an outlet 16 and a vapor vent valve 18 connected to the outlet 16. The evaporative emission control system 10 also includes a carbon canister 18 having an inlet port 20 and a canister vent valve 22 connected thereto. The carbon canister 18 has a purge air inlet 24 connected to the canister vent valve 22. The carbon canister 18 also has an outlet port 26 and a vapor line 28 interconnecting the outlet ports 26 and 16. The evaporative emission control system 10 includes a purge line 30 interconnecting the engine 12 and the outlet port 26 and vapor line 28. The evaporative emission control system 10 further includes a purge valve 32 connected to the purge line 30 to control purging to the engine 12.

Vapor leaving the fuel tank 14 past the vapor vent valve 18 and outlet port 16 enters the vapor line 28 before passing to the outlet port 26 of the carbon canister 18. During periods in which the motor vehicle is not being operated, fuel vapor is stored within the carbon canister 18. When the engine 12 is being operated, the canister vent valve 22 is open and ambient air is drawn through purge air inlet 24 and inlet port 20, then through carbon canister 18 and through outlet port 26, and then through purge line 30 past purge valve 32 and into the engine 12.

The evaporative emission control system 10 includes an electronic control module (ECM) 34 electrically connected to the purge valve 32 to control the rate of purging by operating purge valve 32 and a pressure transducer 36 electrically connected to the ECM 34, which receives evaporative emission control (purge) system pressure information from the pressure transducer 36. It should be appreciated that the ECM 34 transmits and receives information from the engine 12. It should also be appreciated that the evaporative emission control system 10 is similar to that disclosed in U.S. Pat. No. 5,816,223 to Jamrog et al., the disclosure of which is hereby incorporated by reference.

Air drawn through the carbon canister 18 causes desorption of fuel vapor stored in the carbon canister 18. The fuel vapor and air flowing from the carbon canister 18 are combined with additional vapors from the fuel tank 14. During the vapor purging process, the pressure transducer 36 is used to track the purge system pressure within the vapor line 28. The purge system pressure may change for a variety of reasons. For example, the composition of the fuel and its temperature will affect pressure within the vapor line 28. Feed forward fuel vapor concentration change sensing strategy relies on the monitoring of the evaporative emission control system 10 for significant, sudden changes in system operating pressure. As a result, a new method to be described is provided to determine purge system operating pressure changes.

Figure 2:
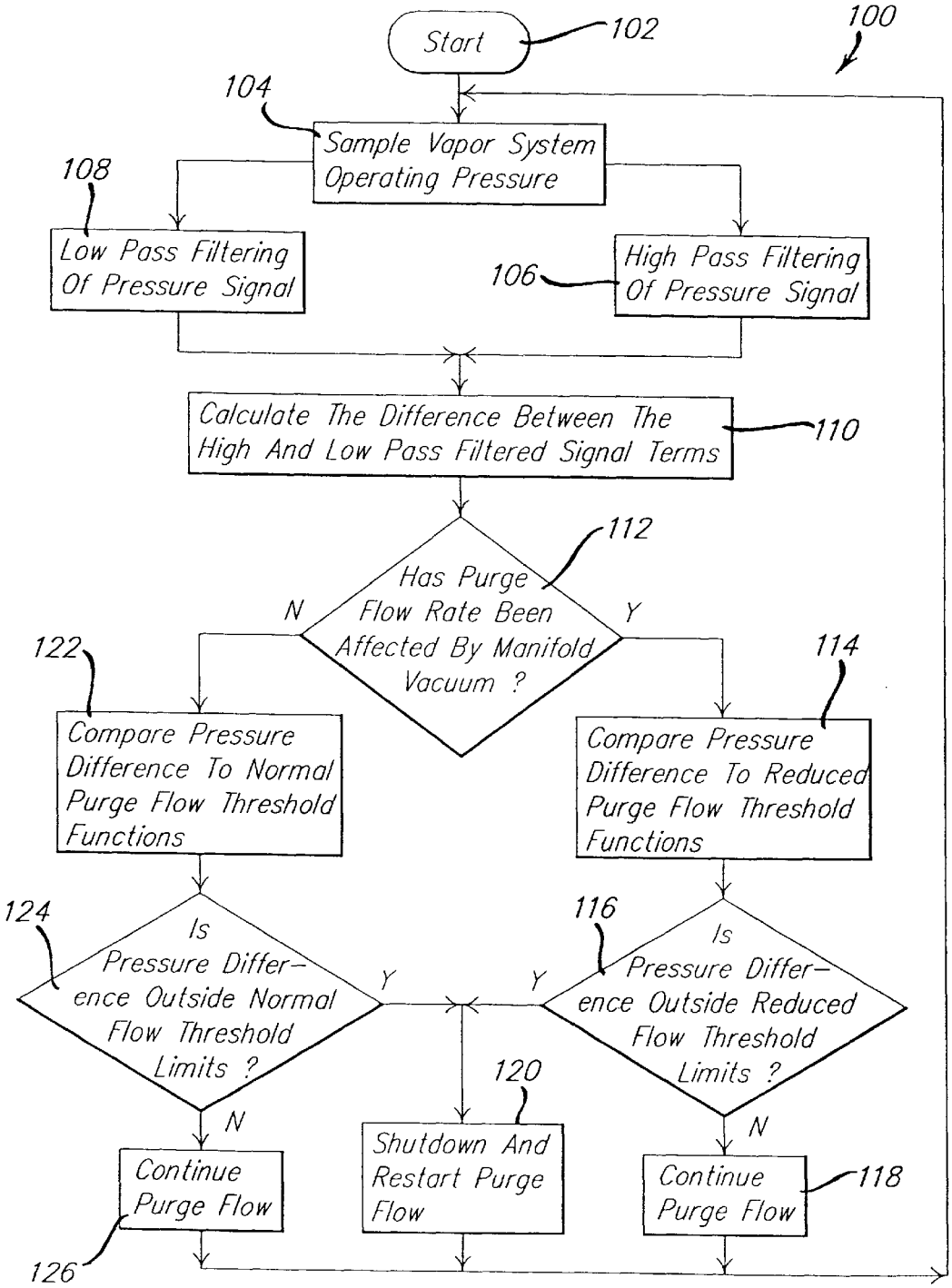
FIG. 2 is a flowchart of a method, according to the present invention, for controlling the evaporative emission control system of FIG. 1.

Referring to FIG. 2, a method, according to the present invention, for controlling the evaporative emission control system 10 is shown at 100. The method starts in bubble 102 when called for by the ECM 34 and advances to block 104. In block 104, the method samples vapor system operating pressure to measure the purge system pressure. The pressure transducer 36 senses a system pressure of the evaporative emission control system 10, which is received as a signal by the ECM 34, which periodically measures the system pressure. The method advances to block 106 and performs high pass filtering of the pressure signal to create a high pass signal. The ECM 34 runs the raw pressure signal from the transducer 36 through two separate filters to create two separate signals. The first or high pass signal is created by high pass filtering which filters out higher frequency pressure signal noise such as 0.25 kpa/sec. The high pass signal determines the short term average system operating pressure. The method advances to block 108 and performs low pass filtering of the pressure signal to create a low pass signal. The second or low pass signal is created from low pass filtering which eliminates moderate and long time period pressure signal noise such as 0.031 kpa/sec. The low pass signal determines the long term average system operating pressure. It should be appreciated that the raw pressure signal from the pressure transducer 36 is run through two separate rolling average filters of differing rolling average time constants (time lengths) such as 0.5 and 4.0 seconds.

From either block 106 or 108, the method advances to block 110 and calculates a pressure difference between the high and low pass filtered signals or terms. The ECM 34 calculates the difference between the high pass and low pass signals to determine when significant changes in system vapor flow are taking place. From block 110, the method advances to diamond 112 and determines whether a purge flow rate has been affected by manifold vacuum. The ECM 34 determines whether the purge flow rate has been affected by manifold vacuum loss at the engine 12 such as twenty-five percent (25%) loss in flow. If so, the method advances to block 114 and compares the calculated pressure difference to a reduced purge flow threshold function of engine air flow consumption rate versus critical pressure differential, which is an x-y table stored in memory of the ECM 34. The ECM 34 compares the calculated pressure difference to the table stored in memory thereof. The method then advances to diamond 116 and determines whether the calculated pressure difference is outside reduced flow pressure differential threshold limits as governed by engine air mass consumption rate. The ECM 34 compares the calculated pressure difference to the threshold limits stored in memory thereof. If not, the method advances to block 118 and continues purge flow. The ECM 34 continues purge flow by opening the purge valve 32. The method then returns to block 104 previously described.

In diamond 116, if the pressure difference is outside reduced flow pressure differential threshold limits, the method advances to block 120 and performs shutdown and restarts purge flow. The ECM 34 shutdowns or closes the purge valve 32 and restarts purge flow by opening the purge valve 32. The method then returns to block 104 previously described.

Returning to diamond 112, if the purge flow rate has not been affected by manifold vacuum, the method advances to block 122. In block 122, the method compares the pressure difference to a normal purge flow threshold function as governed by engine air flow consumption rate previously described. The ECM 34 compares the calculated pressure difference to the table stored in memory thereof. The method then advances to diamond 124 and determines whether the calculated pressure difference is outside normal flow pressure differential threshold limits as governed by engine air mass consumption rate. The ECM 34 compares the calculated pressure difference to the threshold limits stored in memory thereof. If so, the method advances to block 120 previously described. If not, the method advances to block 126 and continues purge flow. The ECM 34 continues purge flow by opening the purge valve 32. From either block 126 or block 120, the method returns to block 104 previously described.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A method for controlling an evaporative emission control system for a motor vehicle, said method comprising the steps of:

periodically measuring a system pressure within the evaporative emission control system;

filtering a signal of the system pressure into two separate signals;

calculating a pressure difference between the signals;

comparing the pressure difference to predetermined pressure differential threshold limits; and adjusting the flow of purged vapor to an engine in the event that the calculated pressure difference is outside the predetermined pressure differential threshold limits.

2. A method as set forth in claim 1 wherein said step of adjusting comprises shutting down and restarting purge flow of the evaporative emission control system.

3. A method as set forth in claim 1 including the step of continuing purge flow to the engine if the calculated pressure difference is within the predetermined pressure differential threshold limits.

4. A method as set forth in claim 1 wherein said step of filtering comprises filtering a signal of the system pressure using a low pass filter to obtain a low pass filtered signal term.

5. A method as set forth in claim 4 wherein said step of filtering further comprises filtering a signal of the system pressure using a high pass filter to obtain a high pass filtered signal term.

6. A method as set forth in claim 5 wherein said step of calculating comprises calculating a difference between the high and low pass filtered signal terms.

7. A method as set forth in claim 1 including the step of determining whether purge flow rate has been affected by manifold vacuum.

8. A method as set forth in claim 7 wherein said step of comparing comprises comparing the pressure difference to a normal purge flow threshold function if the purge flow rate has not been affected by manifold vacuum.

9. A method as set forth in claim 7 wherein said step of comparing comprises comparing the pressure difference to a reduced purge flow threshold function if the purge flow rate has been affected by manifold vacuum.

10. A method as set forth in claim 8 including the step of determining whether the pressure difference is outside normal flow pressure differential threshold limits.

11. A method as set forth in claim 9 including the step of determining whether the pressure difference is outside reduced flow pressure differential threshold limits.

12. A method for controlling an evaporative emission control system for a motor vehicle, said method comprising the steps of:

periodically measuring a system pressure within the evaporative emission control system;

filtering a signal of the system pressure into a high pressure signal and a low pressure signal;

calculating a pressure difference between the high pressure signal and the low pressure signal;

comparing the pressure difference to a predetermined pressure differential threshold limits; and adjusting the flow of purged vapor to engine in the event that the calculated pressure difference is outside the predetermined pressure differential threshold limits.

13. A method as set forth in claim 12 including the step of determining whether purge flow rate has been affected by manifold vacuum.

14. A method as set forth in claim 13 wherein said step of comparing comprises comparing the pressure difference to a normal purge flow threshold function if the purge flow rate has not been affected by manifold vacuum.

15. A method as set forth in claim 14 including the step of determining whether the pressure difference is outside normal flow pressure differential threshold limits.

16. A method as set forth in claim 13 wherein said step of comparing comprises comparing the pressure difference to a reduced purge flow threshold function if the purge flow rate has been affected by manifold vacuum.

17. A method as set forth in claim 12 including the step of determining whether the pressure difference is outside reduced flow pressure differential threshold limits.

18. A method as set forth in claim 12 wherein said step of adjusting comprises shutting down and restarting purge flow of the evaporative emission control system.

19. A method as set forth in claim 12 including the step of continuing purge flow to the engine if the calculated pressure difference is within the predetermined pressure differential threshold limits.

20. A method for controlling an evaporative emission control system for a motor vehicle, said method comprising the steps of:

periodically measuring a system pressure within the evaporative emission control system;

filtering a signal of the system pressure into a high pressure signal and a low pressure signal;

calculating a pressure difference between the high pressure signal and the low pressure signal;

determining whether purge flow rate has been affected by manifold vacuum;

comparing the pressure difference to a predetermined pressure differential threshold limits; and shutting down and restarting purge flow of the evaporative emission control system if the calculated pressure difference is outside the predetermined pressure differential threshold limits; and continuing purge flow to the engine if the calculated pressure difference is within the predetermined pressure differential threshold limits.

* * * * *